US006552290B1

(12) United States Patent
Lawandy

(10) Patent No.: US 6,552,290 B1
(45) Date of Patent: Apr. 22, 2003

(54) OPTICALLY-BASED METHODS AND APPARATUS FOR PERFORMING SORTING CODING AND AUTHENTICATION USING A GAIN MEDIUM THAT PROVIDES A NARROWBAND EMISSION

(75) Inventor: Nabil M Lawandy, North Kingstown, RI (US)

(73) Assignee: Spectra Systems Corporation, Providence, RI (US)

( * ) Notice: Subject to any disclaimer, the term of this patent is extended or adjusted under 35 U.S.C. 154(b) by 0 days.

(21) Appl. No.: 09/246,818

(22) Filed: Feb. 8, 1999

(51) Int. Cl.[7] ..... B07C 5/342; G07D 7/06

(52) U.S. Cl. ..... 209/576; 283/85; 372/96

(58) Field of Search ..... 283/85, 86, 91, 283/92; 372/1, 66, 67, 96; 356/71; 250/271, 566, 569; 209/576–582, 587

(56) References Cited

U.S. PATENT DOCUMENTS

| | | | | |
|---|---|---|---|---|
| 2,208,653 A | | 7/1940 | Whitehead | 162/140 |
| 2,255,696 A | | 9/1941 | Clifford | 250/488.1 |
| 3,068,063 A | | 12/1962 | Kiefer et al. | 264/207 |
| 3,760,292 A | * | 9/1973 | Kogelnik et al. | |
| 4,437,935 A | | 3/1984 | Crane, Jr. | 162/103 |
| 4,442,170 A | | 4/1984 | Kaule et al. | 428/333 |
| 4,451,521 A | | 5/1984 | Kaule et al. | 428/199 |
| 4,452,843 A | | 6/1984 | Kaule et al. | 428/199 |
| 4,533,244 A | | 8/1985 | Kaule et al. | 356/71 |
| 4,534,398 A | | 8/1985 | Crane | 162/103 |
| 4,598,205 A | | 7/1986 | Kaule et al. | 250/458 |
| 4,678,322 A | | 7/1987 | Finkel et al. | 355/133 |
| 4,738,901 A | | 4/1988 | Finkel et al. | 428/690 |
| 4,791,645 A | * | 12/1988 | Komatsubara | 372/5 |

(List continued on next page.)

FOREIGN PATENT DOCUMENTS

| | | |
|---|---|---|
| CH | 516196 A | 11/1971 |
| DE | 2037755 B2 | 8/1975 |
| DE | 4114732 A1 | 11/1992 |
| EP | 0066854 B1 | 4/1985 |
| GB | 417488 | 10/1934 |
| WO | WO 90/06539 A1 | 6/1990 |
| WO | WO 98/39163 A2 | 9/1998 |

OTHER PUBLICATIONS

Balachandran, R. M. et al., "Photonic textile fibers", Applied Optics, vol. 35, No. 12, Apr. 20, 1996, pp. 1991–1994.
Vietze, U. et al., "Zeolite–dye micro lasers," Jul. 27, 1998, pp. 1–8.

*Primary Examiner*—Rodney Bovernick
*Assistant Examiner*—Mike Stahl
(74) *Attorney, Agent, or Firm*—Harrington & Smith, LLP

(57) ABSTRACT

Disclosed are methods and apparatus for at least one of authenticating, sorting or counting documents, as well as to security structures contained within documents and to documents containing security structures. A security device or structure includes an optical gain medium and a structure having boundaries that impart an overall geometry to the structure that, in combination with at least one material property of the structure, favors in one embodiment the creation of at least one mode that enhances an emission of electromagnetic radiation within a narrow band of wavelengths. Suitable shapes for the structure comprise elongated, generally cylindrical shapes such as filaments, a sphere shape, a partial-sphere shape, a toroidal shape, a cubical and other polyhedral shape, and a disk shape. The structure preferably comprises at least one of a monolithic structure or a multi-layered structure or an ordered structure that may provide for distributed optical feedback. In a preferred embodiment the security device forms a part of a currency, a passport, a lottery ticket, a negotiable security, a credit card or debit card, or any substrate or carrier which it is desired to at least one of authenticate, count, encode, sort or verify.

23 Claims, 4 Drawing Sheets

U.S. PATENT DOCUMENTS

| | | | | | |
|---|---|---|---|---|---|
| 5,026,141 | A | * | 6/1991 | Griffiths | 250/227.14 |
| 5,093,147 | A | | 3/1992 | Andrus et al. | 427/7 |
| 5,291,267 | A | * | 3/1994 | Sorin et al. | 356/345 |
| 5,434,878 | A | | 7/1995 | Lawandy | 372/43 |
| 5,448,059 | A | * | 9/1995 | Blank et al. | 250/227.21 |
| 5,448,582 | A | | 9/1995 | Lawandy | 372/42 |
| 5,486,022 | A | | 1/1996 | Crane | 283/83 |
| 5,625,456 | A | | 4/1997 | Lawandy | 356/376 |
| 5,881,886 | A | * | 3/1999 | Lawandy | 209/3.3 |
| 5,903,340 | A | | 5/1999 | Lawandy et al. | 356/71 |
| 6,234,537 | B1 | | 5/2001 | Gutmann et al. | 283/86 |
| 6,259,506 | B1 | * | 7/2001 | Lawandy | 349/193 |

* cited by examiner

OPTICALLY-BASED METHODS AND APPARATUS FOR PERFORMING SORTING CODING AND AUTHENTICATION USING A GAIN MEDIUM THAT PROVIDES A NARROWBAND EMISSION

FIELD OF THE INVENTION

This invention relates generally to optically-based methods and apparatus for performing sorting, coding and authentication of objects, such as paper or polymer based objects including currency, checks, negotiable instruments, passports, wills and other documents.

BACKGROUND OF THE INVENTION

In U.S. Pat. No. 5,448,582, issued Sep. 5, 1995, entitled "Optical Sources Having a Strongly Scattering Gain Medium Providing Laser-Like Action", the inventor disclosed a multi-phase gain medium including an emission phase (such as dye molecules) and a scattering phase (such as $TiO_2$). A third, matrix phase may also be provided in some embodiments. Suitable materials for the matrix phase include solvents, glasses and polymers. The gain medium is shown to provide a laser-like spectral linewidth collapse above a certain pump pulse energy. The gain medium is disclosed to be suitable for encoding objects with multiple-wavelength codes, and to be suitable for use with a number of substrate materials, including polymers and textiles.

It is well known in the art to use various security techniques in an attempt to provide paper and other printable substrates that can be readily authenticated. Once the paper is authenticated, then the document or instrument printed on the paper may be assumed to be authentic as well, or at least to have passed a threshold test of authenticity. Watermarks, holograms, color changing inks and the like have all be used in the past. One well known technique places security threads in paper to hinder a non-authorized production of the paper or to authenticate already manufactured paper and/or a document or currency printed on the paper. Reference in this regard can be had to the following U.S. Patent U.S. Pat. No. 5,486,022, "Security Threads Having At Least Two Security Detection Features and Security Papers Employing Same", by T. T. Crane; U.S. Pat. No. 4,534,398, "Security Paper", by T. T. Crane; and U.S. Pat. No. 4,437,935, "Method and Apparatus for Providing Security Features in Paper", by F. G. Crane, Jr.

In addition to the problem of authentication, other problems arise with the use of currency, documents, and other pliable substrates (e.g. textiles) such as when using automatic sorting and counting machines. In such applications the sorting and/or counting machine should be able to accurately distinguish between different denomination notes, while doing so in a real time environment where the notes are moving at a relatively high velocity.

A problem also arises during a conventional use of fluorescent or phosphorescent materials. This problem is related to the saturation behavior of the optical output that is typical of these materials. Due to this saturation behavior the signal to noise properties of the output are degraded, especially for non-contact substrate processing.

A very advantageous solution to the various problems discussed above would be to provide a security structure that could be incorporated into the matrix that forms the document, currency, negotiable instrument, etc., wherein the structure could function to both authenticate the substrate as well as to enhance the countability and/or sortability of the substrate. The security structure should be small so that it can incorporated into substrates, low cost, and exhibit non-saturating or substantially non-saturating behavior that provides the structure with a high signal to noise output and a capability of being used in a non-contact, high speed mode of operation. An optically-based security structure in accordance with the teachings of this invention would enable such a non-contact, high speed mode of operation.

OBJECTS AND ADVANTAGES OF THE INVENTION

It is thus a first object and advantage of this invention to provide an improved optically based method and apparatus for authenticating objects, and possibly also counting and sorting objects, such as documents, currency, negotiable instruments, and other substrates that contain indicia.

It is another object and advantage of this invention to provide an optically-based security structure that can be used in thin substrate materials, such as sheet-like substrate materials based on paper or polymer.

It is a further object and advantage of this invention to provide a document or document substrate, such as paper or a polymer, that is printed and/or constructed so as enable the document or substrate to be accurately and unambiguously authenticated as being genuine, as well as to have enhanced counting and sorting properties.

It is another object and advantage of this invention to provide a mode or amplified spontaneous emission (ASE) structure that allows for the circumvention of the conventional output saturation behavior that is typical of conventional fluorescent or phosphorescent materials, thereby greatly enhancing the signal to noise properties of the output from the substrate and allowing for highly improved and robust non-contact processing.

It is one further object and advantage of this invention to provide an amplified spontaneous emission (ASE) structure in homogeneously or inhomogeneously broadened medium allowing for highly improved and robust non-contact processing of substrates, such as those that comprise currency and other documents.

SUMMARY OF THE INVENTION

The foregoing and other problems are overcome and the objects and advantages of the invention are realized by methods and apparatus in accordance with embodiments of this invention.

Disclosed herein are methods and apparatus for at least one of authenticating, sorting or counting documents, as well as security structures contained within documents. The apparatus includes a laser or some other light source for illuminating all or a portion of a document. The document includes a substrate and at least one security structure or device located in or on the substrate.

In accordance with the teachings of this invention the security structure includes, in one embodiment, a gain medium coupled to a structure that supports the creation of at least one mode for electromagnetic radiation.

Further in accordance with the teachings of this invention the security structure includes, in another embodiment, a gain medium coupled to a structure having a dimension or length in one or more directions to produce and support amplified spontaneous emission (ASE).

A security device in accordance with this invention has a structure with boundaries whose geometry and material properties (e.g., index of refraction) support an enhancement of electromagnetic radiation that may be emitted from a gain medium, such as a dye and/or semiconductor particles, that is also contained within the device. The structure may be provided so as to favor the creation of at least one mode so as to enhance electromagnetic radiation within a narrow band of wavelengths. Suitable shapes for the structure include, but are not limited to, elongated generally cylindrical shapes such as filaments, spheres, half-spheres, toroids, cubes and other polyhedral shapes, as well as disks. The structures may be monolithic structures or multi-layered structures, or a combination of same. Preferably the security devices containing the structures are of a size compatible with the dimensions of the substrate or carrier into which they are placed, such as paper or thin polymer sheets such as those used for credit cards, debit cards and identification cards, such as driver's licenses.

A laser source may output light having wavelengths that are predetermined to excite the gain medium. Apparatus that comprises the laser further includes at least one photodetector, or an array of photodetectors, that is responsive to at least one predetermined wavelength, and decision logic for at least one of indicating the authenticity of a document containing the security device, for counting the document, or for sorting the document. The decision logic operates based at least in part on a detection of the at least one predetermined wavelength or on the absence of at least one predetermined wavelength. In addition, the decision process for authentication may include the linewidth and other spectral features of the signature, such as its derivative. These parameters may be employed to further corroborate the presence of a lasing emission signature.

As employed herein a document could be a currency, or a passport, or a lottery ticket, or a negotiable security, or a credit card or a debit card, or an identification card such as a driver's license or employee's badge, or any substrate or carrier which it is desired to authenticate, count, encode with information, sort and/or verify.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
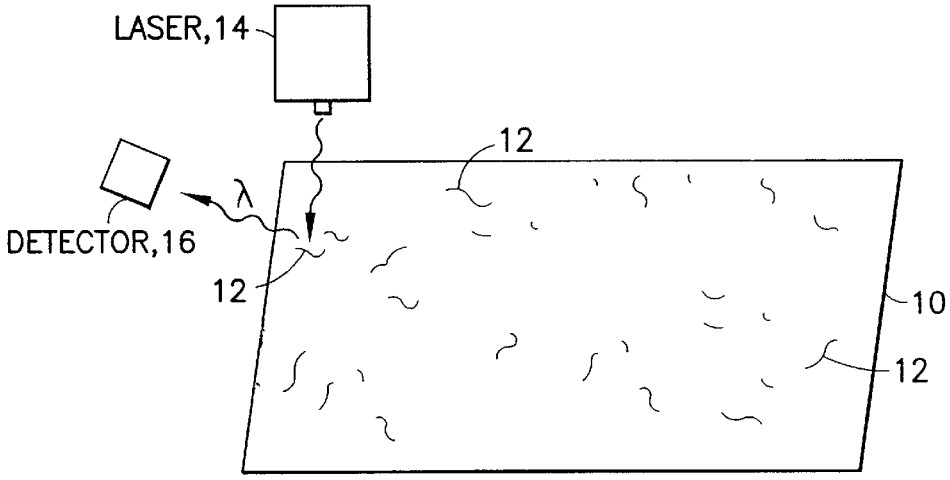
FIG. 1 illustrates a document having embedded fibers or threads that emit narrow-band light, when excited by an optical source such as a laser, containing one or more characteristic wavelengths.

The disclosure of the above-referenced U.S. Pat. No. 5,448,582, issued Sep. 5, 1995, entitled "Optical Sources Having a Strongly Scattering Gain Medium Providing Laser-Like Action", by Nabil M. Lawandy is incorporated by reference herein in its entirety. Also incorporated by reference herein in its entirety is the disclosure of U.S. Pat. No. 5,434,878, issued Jul. 18, 1995, entitled "Optical Gain Medium Having Doped Nanocrystals of Semiconductors and also Optical Scatterers", by Nabil M. Lawandy.

This invention employs security structures that contain an optical gain medium that is capable of exhibiting laser-like activity (e.g., emission in a narrow band of wavelengths when excited by a source of excitation energy).

However, unlike the structures disclosed in the above-referenced U.S. Pat. No. 5,448,582, the security structures in accordance with the teachings of this invention do not require the presence of a scattering phase or scattering sites to generate the narrow band of emissions. Instead, the optical gain medium that provides the amplified spontaneous emission in response to the illumination is responsive to, for example, size constraints, structural constraints, geometry constraints, and/or index of refraction mismatches for emitting the narrow band of emissions. In other words, the size constraints, structural constraints, geometry constraints, and/or index of refraction mismatches are used to provide for at least one mode in the security structure that favors at least one narrow band of wavelengths over other wavelengths, enabling emitted energy in the narrow band of wavelengths to constructively add. In another embodiment the size constraints, structural constraints, geometry constraints, and/or index of refraction mismatches are used to provide for an occurrence of amplified spontaneous emission (ASE) in response to the step of illuminating.

It should be noted that one may provide ASE within a mode, but that one does not require a mode to have ASE. In general, the ASE can occur in homogeneously and inhomogeneously broadened medium.

The security structure is thus comprised of a matrix phase, for example a polymer or solvent, that is substantially transparent at wavelengths of interest, and an electromagnetic radiation amplifying (gain) phase, for example a dye or a rare earth ion. The amplifying (gain) phase is placed within a structure, in accordance with the teachings of this invention, where the structure has a predetermined size, or structural features, or geometry, and/or an index of refraction that differs from the index of refraction of the substrate within which the security structure is intended for use. The structure tends to confine and possibly guide the electromagnetic radiation output from the amplifying (gain) phase, and may favor the creation of at least one mode, or the creation of amplified spontaneous emission (ASE). In either case the output may be contained in a narrow range of wavelengths, e.g., a few nanometers in width, and is considered herein as a narrowband emission. The matrix phase may comprise the material that forms the security structure, such as a polymeric planchette that contains the electromagnetic radiation amplifying (gain) phase.

The invention is applied herein to the validation of the authenticity of documents, currency, checks, lottery tickets, and other similar instruments that are typically provided on paper or a paper-containing or paper-like substrate, as well as to automated methods and apparatus for counting and/or sorting such substrates. For the purposes of this invention a "security device" or "security structure" is intended to mean an object that is fabricated in accordance with this invention and which has dimensions suitable for being included within a desired substrate material, such as the paper of currency or a passport. Whether the object is intended for use in authenticating the substrates, or for counting the substrates, or for sorting the substrates, or for any combination of authentication, counting or sorting, the object is still referred to herein for convenience as a "security structure".

The document or substrate containing the security structure or device could be, but is not limited to, a currency, or a passport, or a lottery ticket, or a negotiable security, or a credit card or a debit card, or an identification card, such as a driver's license or employee's badge, or any substrate or carrier which it is desired to authenticate, count, encode, sort and/or verify.

This invention may also enable both public validation, e.g., by visual inspection, and machine-based validation, e.g., with the use of an optical source and one or more suitable optical detectors. Thus, two levels of authentication can be used.

FIG. 1 illustrates a first embodiment of this invention. A document, including any paper, paper-containing, or polymer substrate 10, includes a plurality of embedded elongated bodies or threads 12 that include a host material, such as a textile fiber or a polymer fiber, that is coated or impregnated with a dye or some other material capable of amplifying light. The threads 12 exhibit electro-optic properties consistent with laser action; i.e., an output emission that exhibits both a spectral linewidth collapse and a temporal collapse at an input pump energy above a threshold level. In response to illumination with laser light, such as frequency doubled light (i.e., 532 nm) from a Nd:YAG laser 14, the threads 12 emit a wavelength $\lambda$ that is characteristic of the chromic dye or other material that comprises the illuminated threads 12. A reflective coating can be applied so as to enhance the emission from the threads 12. An optical detector 16, which may include a wavelength selective filter, can be used to detect the emission at the wavelength $\lambda$. The emission may also be detected visually, assuming that it lies within the visible portion of the spectrum. In either case, the detection of the emission at the characteristic wavelength $\lambda$ indicates that the document is an authentic document, i.e., one printed on the substrate 10 having the threads 12. It is assumed that only authentic documents are printed on such substrates, and that one wishing to fraudulently produce such a document would not have access to the substrate material. Currency is one specific example.

Figure 7:
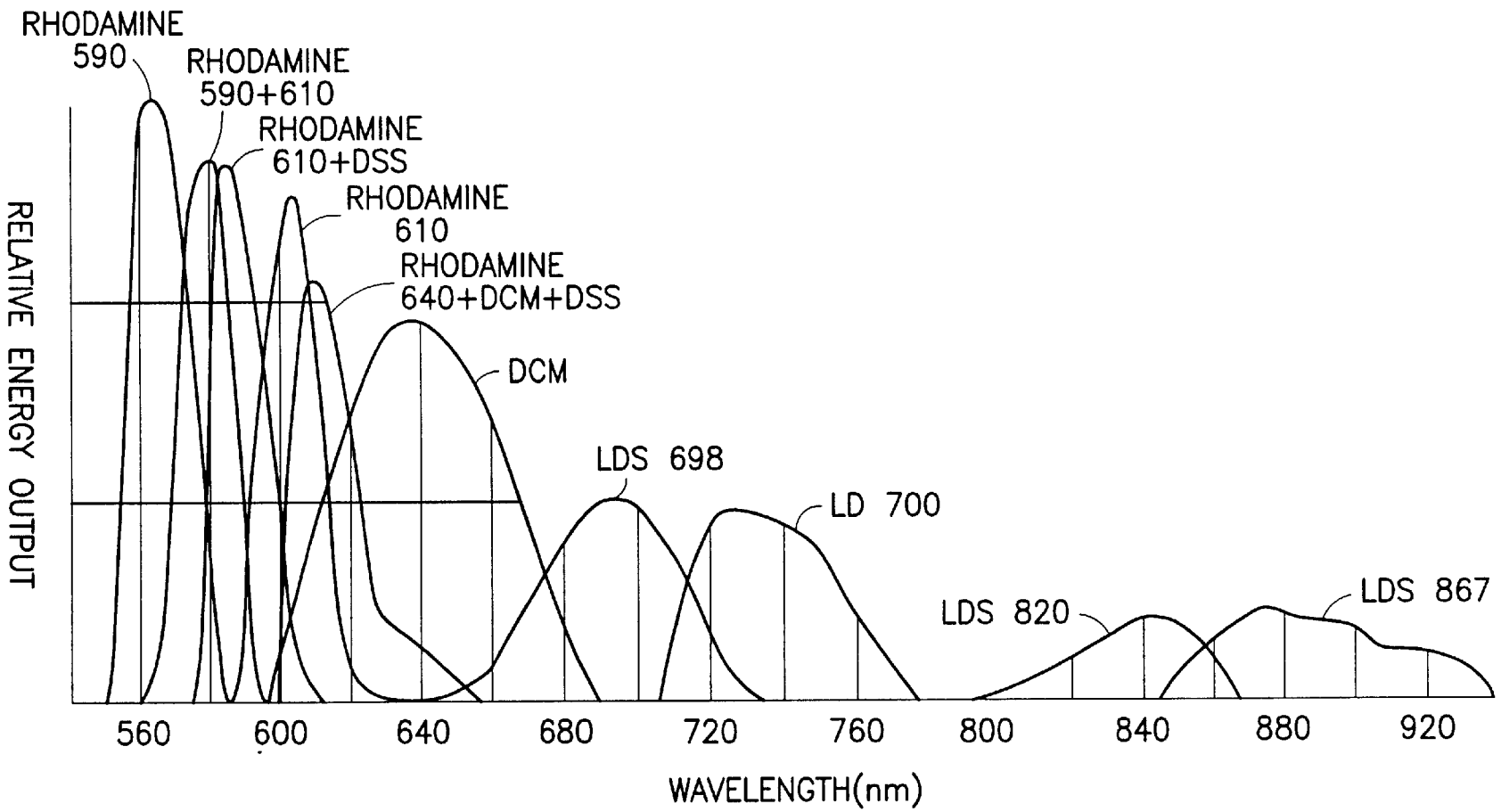
FIG. 7 is a graph that illustrates a number of suitable dyes that can be used to form the gain medium in accordance with this invention.

FIG. 7 illustrates a number of exemplary dyes that are suitable for practicing this invention, and shows their relative energy output as a function of wavelength. The teaching of this invention is not limited for use with only the dyes listed in FIG. 7.

Figure 2A:
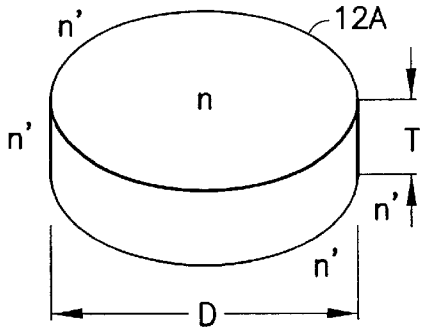
FIG. 2A illustrates a planchette embodiment of a security structure in accordance with the teachings of this invention.

FIG. 2A is an enlarged elevational view of a small disk-shaped security structure, also referred to as a planchette 12A. The planchette 12A has, by example, a circular cylindrical shape with a diameter (D) and a thickness (T) that is less than the dimensions of the substrate material to which the planchette will be added. By example, U.S. currency has a thickness of about 100 microns, and D and T will both be significantly less than 100 microns. Also, and in accordance with this invention, T and $\pi$D, the perimeter, can be chosen to have values that are a function of a desired emission wavelength, such as one half wavelength or some multiple of one half wavelength. To this end the planchette 12A is comprised of a polymer, or a glass, or some other suitable material, which contains an optical amplifying (gain) material, such as one of the dyes shown in FIG. 7. One surface of the planchette 12A may be provided with a reflective coating. It is also preferred that the index of refraction (n) of the planchette 12A be different from the index of refraction (n') of the desired substrate material (i.e., the planchette 12A is non-index matched to the surrounding substrate.)

A planchette can also be designed so that ASE across the thickness T creates a narrowband emission, or such that ASE along an internal reflection path, such as the perimeter, leads to narrowband emission.

Figure 2B:
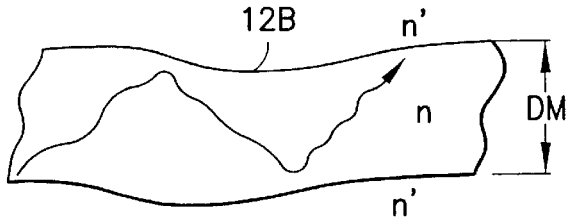
FIG. 2B illustrates a filament or fiber embodiment of a security structure in accordance with the teachings of this invention, and which is suitable for embodying the document threads shown in FIG. 1.

FIG. 2B depicts a fiber embodiment of the security structure, wherein the diameter (DM) of fiber 12B is made to have a value that is a function of the desired emission wavelength, such as one half wavelength or some multiple of one half wavelength. As in the planchette embodiment of FIG. 2A, the fiber 12B is comprised of a polymer, or a glass, or some other suitable material, which contains an optical emitter, such as one of the dyes shown in FIG. 7. It is also again preferred that the index of refraction (n) of the fiber 12B be different from the index of refraction (n') of the desired substrate material so that the fiber 12B is non-index matched to the surrounding substrate. In this embodiment the electromagnetic radiation that is emitted by the dye is confined to the fiber and propagates therein. Due at least in part to the diameter of the fiber 12B one narrowband of wavelengths is preferred over other wavelengths, and energy in this band of wavelengths builds over time, relative to the other wavelengths. Preferably the diameter DM is made a function of the emission wavelength of the selected dye. The end result is a narrowband emission from the fiber 12B, when the dye contained in the matrix material of the fiber 12B is stimulated by an external laser source.

Figure 2C:
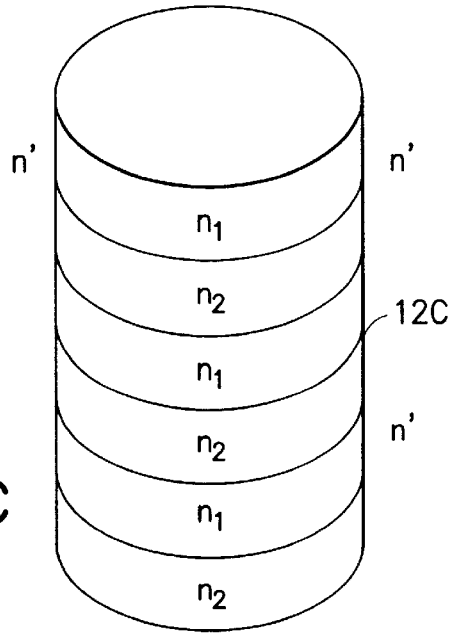
FIG. 2C illustrates a distributed feedback (DFB) embodiment of a security structure in accordance with the teachings of this invention.

FIG. 2C depicts a DFB embodiment of the security structure, wherein a periodic structure comprised of regions of first and second indices of refraction ($n_1$ and $n_2$) alternate along the length of the DFB structure 12C. Preferably $n_1$ is not equal to $n_2$, and neither are equal to n'. The thickness of each of the regions may be one quarter wavelength, or a multiple of one quarter wavelength, of the desired emission wavelength to provide a mode for the desired emission wavelength.

Figure 5:
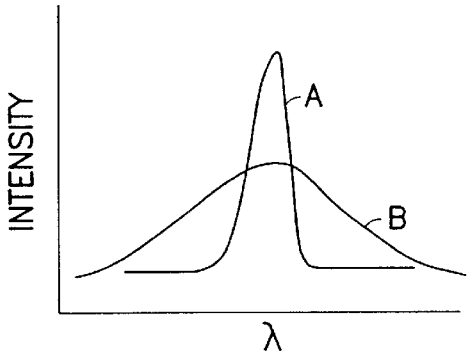
FIG. 5 depicts the emission peak of a selected dye in any of the embodiments of FIGS. 2A–2E, before (B) and after (A) a spectral collapse.

FIG. 5 depicts the emission peak of the selected dye in any of the embodiments of FIGS. 2A–2E, before (B) and after (A) the spectral collapse made possible by the security structure having a predetermined size, or structural features, or geometry, and/or an index of refraction that differs from the index of refraction of the substrate within which the security structure is intended for use.

In general, and for the case of amplified spontaneous emission for high gain, homogeneously broadened media, the general expression is (for a cylinder-type geometry):

$$\Delta\lambda/\Delta\lambda_0=1/\mathrm{sqrt}(2gL),$$

where g is the gain (e.g., 200 $cm^{-1}$), and L is a length that results in narrowband emission. The structure can include a propagating mode, and the mode can help guide the electromagnetic radiation, but the mode is not necessary for ASE to occur. For a dye, the gain g is approximately 200 $cm^{-1}$, so for a ten fold linewidth collapse ($\Delta\lambda/\Delta\lambda_0$=0.1), L is approximately 2.5 mm.

Figure 2D:
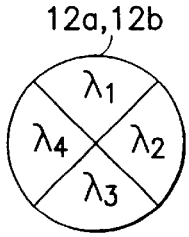
FIG. 2D illustrates a top view of a planchette, as in FIG. 2A, or an end view of fiber, wherein the planchette or fiber is sectored and capable of outputting multiple wavelengths.
Figure 2E:
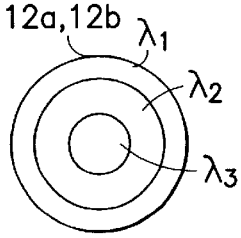
FIG. 2E illustrates a top view of a planchette, as in FIG. 2A, or an end view of fiber, wherein the planchette or fiber is radially structured so as to be capable of outputting multiple wavelengths.

FIG. 2D illustrates a top view of a planchette 12A, as in FIG. 2A, or an end view of fiber 12B, wherein the planchette or fiber is sectored (e.g., four sectors) and is capable of outputting multiple wavelengths ($\lambda_1$–$\lambda_4$). FIG. 2E illustrates a top view of a planchette 12A, as in FIG. 2A, or an end view of fiber 12B, wherein the planchette or fiber is radially structured so as to be capable of outputting multiple wavelengths. Such multiple wavelength embodiments lend themselves to the wavelength encoding of information, as will be described in further detail below.

Figure 3:
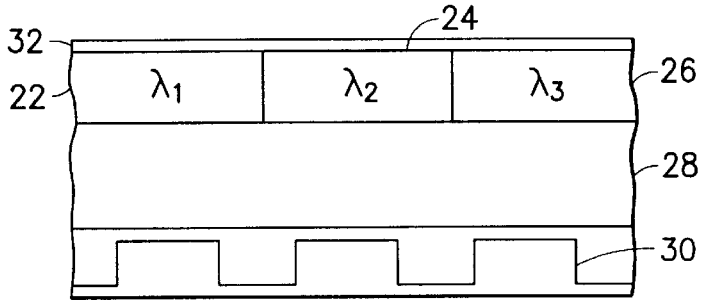
FIG. 3 is an enlarged, cross-sectional view of an embodiment of a security structure that is also suitable for embodying the document threads shown in FIG. 1.

FIG. 3 illustrates an embodiment of a structure wherein a one or more regions (e.g. three) 22, 24, 26 each include, by example, one or more dyes either alone or in combination with one or more rare earths that are selected for providing a desired wavelength $\lambda_1$, $\lambda_2$, $\lambda_3$. An underlying substrate, such as a thin transparent polymer layer 28, overlies a reflective layer 30. The reflective layer 30 can be a thin layer of metal foil, and may be corrugated or otherwise shaped or patterned as desired. The structure can be cut into thin strips which can be used to form the threads 12 shown in FIG. 1. Under low level illumination provided by, for example, a UV lamp a public authentication can be provided based on a characteristic broad band fluorescent emission (e.g., some tens of nanometers or greater) of the dye and/or phosphor particles. However, when excited by the laser 14 the structure emits a characteristic narrowband emission (e.g., less than about 10 nm) at each of the wavelengths $\lambda_1$, $\lambda_2$, $\lambda_3$. The presence of these three wavelengths can be detected with the detector or detectors 16, in combination with suitable optical passband filters (see also FIG. 8), thereby providing also a machine readable authentication of the document containing the structure. Alternatively, a spectrum analyzer (see also FIG. 9) such as monolithic detector array with, by example, an optical wedge can be used to detect the spectrum. The output of the spectrum analyzer is then analyzed for detecting $\lambda$ peaks and derivatives, and can be compared to a predetermined look-up table.

If desired, a suitable coating 32 can be applied to the regions 22, 24 and 26. The coating 32 can provide UV stability and/or protection from abrasive forces. A thin transparent UV absorbing polymer coating is one suitable example, as are dyes, pigments and phosphors.

For the case where the coating 32 is applied, the coating can be selected to be or contain a fluorescent material. In this case the coating 32 can be excited with a UV source to provide the public authentication function.

The threads 12 may be comprised of fibers such as nylon-6, nylon 6/6, PET, ABS, SAN, and PPS. By example, a selected dye may be selected from Pyrromethene 567, Rhodamine 590 chloride, and Rhodamine 640 perchlorate. The selected dye may be compounded with a selected polymer resin and then extruded. Wet spinning is another suitable technique for forming the fibers. A suitable dye concentration is $2\times10^{-3}$ M. Extrusion at 250° C. followed by cooling in a water bath is one suitable technique for forming the fibers 12. When used in a paper substrate the diameter is sized accordingly, and in accordance with the selected emission wavelength. A suitable excitation (pump 12) fluence is in the range about 5 $mJ/cm^2$ and greater. Two or more fibers, each containing a different dye, can be braided together or otherwise connected to provide a composite fiber that exhibits emission at two or more wavelengths. Alternatively, the sectored embodiment of FIG. 2D can be employed, or the radial embodiment of FIG. 2E. It should be realized that simply slicing fibers so constructed can be used to create the planchettes 12A.

Figure 6:
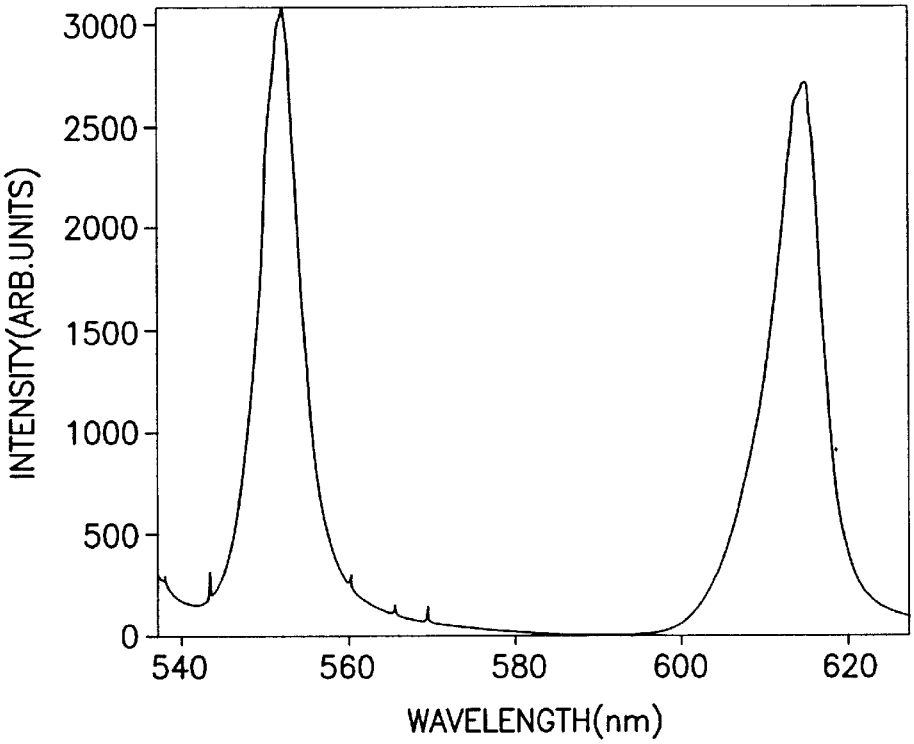
FIG. 6 shows characteristic emission peaks for a thread comprised of a plurality of constituent polymeric fibers, each of which emits at a characteristic wavelength.

By example, FIG. 6 illustrates the emission from a braided pair of nylon fibers, excited at the 532 nm line of a frequency doubled Nd:YAG laser 12, containing $2\times10^{-3}$ M Pyrromethene 567 and Rhodamine 640 perchlorate with emission peaks at 552 nm and 615 nm, respectively. By varying the dye-doped fiber types in various combinations of braided or otherwise combined fibers, the resulting composite fibers or threads 12 make it possible to optically encode information into the paper or other host material. By example, currency can be encoded with its denomination by the selection of thread emission wavelength(s). For example, $100 notes would emit with a first characteristic optical signature, while $50 notes would emit with a second characteristic optical signature. The characteristic emission lines may be more narrowly spaced than shown in FIG. 6. By example, in that the emission lines of individual ones of the fibers are of the order of 4 nm, one or more further emission wavelengths can be spaced apart at about 6 nm intervals.

The dye can also be incorporated by a dyeing process of polymers with active sites and specifically designed dyes that bind to the active sites.

It is also within the scope of the invention to provide a single fiber with two dyes, where the emission from one dye is used to excite the other dye, and wherein only the emission from the second dye may be visible.

In one embodiment Rhodamine 640 is excited at 532 nm. The Rhodamine 640 emits 620 nm radiation with is absorbed by Nile Blue, which in turn emits at 700 nm.

Figure 4:
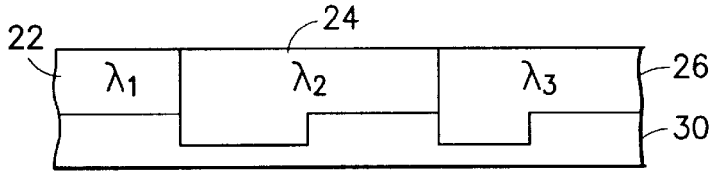
FIG. 4 is an enlarged, cross-sectional view of another embodiment of the security structure of FIG. 3.

FIG. 4 illustrates an embodiment wherein the polymer substrate 28 of FIG. 3 is removed, and the regions 22, 24 and 26 are disposed directly over the patterned metal or other material reflector layer 30. In this embodiment it can be appreciated that a thickness modulation of the gain medium regions occurs, enabling multiple wavelengths to be produced if multiple dyes are included.

Figure 8:
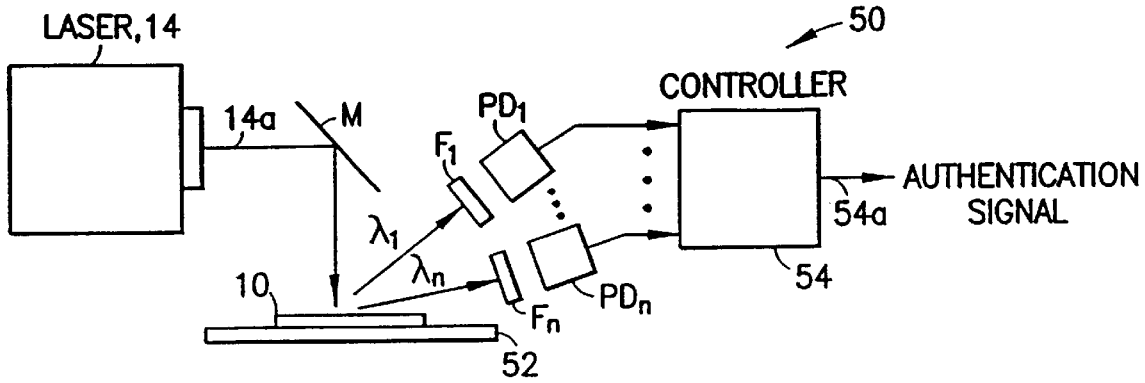
FIG. 8 is a simplified block diagram of a document authentication system that is an aspect of this invention.

FIG. 8 illustrates an embodiment of a suitable apparatus for authenticating a document in accordance with one aspect of this invention. The authentication system 50 includes the laser 14, such as but not limited to a frequency doubled Nd:YAG laser, that has a pulsed output beam 14*a*. Beam 14*a* is directed to a mirror M and thence to the document 10 to be authenticated. The document 10, which could be currency, is disposed on a support 52. One or both of the mirror M and support 52 may be capable of movement, enabling the beam 12*a* to be scanned over the document 10. Assuming that the document 10 includes the threads 12, and/or the planchettes 12A, or any of the other disclosed embodiments of security structures, one or more emission wavelengths (e.g., $\lambda_1$ to $\lambda_n$) are generated. A suitable passband filter F can be provided for each emission wavelength of interest (e.g., F1 to Fn). The output of each filter F1–Fn is optically coupled through free space or through an optical fiber to a corresponding photodetector PD1 to PDn. The electrical outputs of PD1 to PDn are connected to a controller 54 having an output 54*a* for indicating whether the document 10 is authentic. The document 10 is declared to be authentic only when all of the expected emission wavelengths are found to be present, i.e., only when PD1 to PDn each output an electrical signal that exceeds some predetermined threshold. A further consideration can be an expected intensity of the detected wavelength(s) and/or a ratio of intensities of individual wavelengths one to another.

Figure 9:
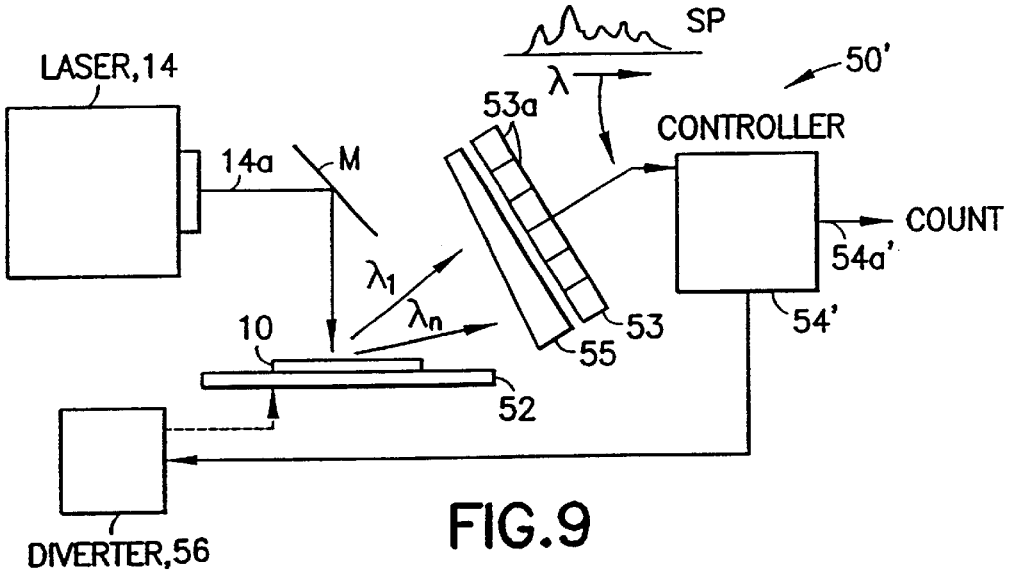
FIG. 9 is a simplified block diagram of a document sorting and counting system that is an aspect of this invention.

It should be realized that the support 52 could be a conveyor belt that conveys documents past the stationary or scanned beam 12*a*. It should further be realized that a prism, wedge or grating could replace the individual filters F1–Fn, in which case the photodetectors PD1–PDn are spatially located so as to intercept the specific wavelength outputs of the prism or grating. The photodetectors PD1–PDn could also be replaced by one or more area imaging arrays, such as a silicon or CCD imaging array, as is shown in FIG. 9. In this case it is expected that the array will be illuminated at certain predetermined pixel locations if all of the expected emission wavelengths are present. It is assumed that the photodetector(s) or imaging array(s) exhibit a suitable electrical response to the wavelength or wavelengths of interest. However, and as was noted above, it is possible to closely space the emission wavelengths (e.g., the emission wavelengths can be spaced about 6 nm apart). This enables a plurality of emission wavelengths to be located within the maximum responsivity wavelength range of the selected detector(s).

The controller 54 can be connected to the laser 14, mirror M, support 52, and other system components, such as a rotatable wedge that replaces the fixed filters F1–Fn, for controlling the operation of these various system components.

FIG. 9 is a simplified block diagram of a document sorting and counting system 50' that is a further aspect of this invention. The apparatus of FIG. 9 can be similar to that of FIG. 8, however, the controller 54' outputs a Count signal 54*a*', and may also provide a signal to a diverter mechanism 56 for directing the document being examined to a predetermined destination. In this embodiment it is assumed that the support 52 is a conveyor belt or some similar apparatus that conveys documents past the stationary or scanned beam 14*a*. If only a counting function is used then a minimum of one wavelength (and hence one photodetector) need be employed, assuming that only one type of document is to be counted. One wavelength could also be employed in the sorting case, if it were assumed that a desired document emits a predetermined wavelength while other documents do not emit at all, or emit at a different wavelength. In this case the diverter mechanism 56 may be activated either if the expected emission is present or is not present.

FIG. 9 also shows the case where the discrete photodetectors of FIG. 8 are replaced by a monolithic area array 53 comprised of pixels 53*a*. The array 53, in combination with some type of device for spatially distributing the output spectrum over the array, such as a wedge 55, provides a spectrum analyzer in combination with controller 54'. That is, the spectrum (SP) emanating from the document 10 is detected and converted to an electrical signal for analysis by software in the controller 54'. By example, the peaks in the spectrum are identified and are associated with particular wavelengths by their locations on the array 53. Information that is conveyed by the wavelength peaks (and/or some other spectral feature, such as the peak width, or peak spacing, or the derivative) is then used to authenticate the document 10, or to detect a type of document or to ascertain some other information about the document, and/or to count and/or sort the document.

It should be realized that the embodiments of FIGS. 8 and 9 could be combined into one apparatus that authenticates, counts and sorts documents, such as currency or financial instruments.

Further in accordance with the teachings of this invention the coding of various substrates can be accomplished by a strictly binary wavelength domain code, or by an approach that also includes the amplitude of the signals.

In the binary scheme the substrates may be impregnated with combinations of N lasing wavelengths out of a total palette of M lasing wavelengths. The presence of a signal at a specific wavelength denotes a "1" while its absence denotes a "0". If M wavelength choices are available, for example in the form of fibers 12B or planchettes 12A, then there exist a total of $2^M-1$ possible codes. For example, M=3 different wavelength fibers can create seven different codes. This approach can, for example, be used to code the existing denominations of U.S. currency.

Furthermore, if only N wavelengths at a time are incorporated in any given substrate, then there exist $$Z_M^N = \frac{M!}{(M-N)!N!}$$

possibilities, where ! indicates factorial. For example, with M=5 different laser wavelengths to choose from one has:

$Z_1^5$ (1 fiber in each substrate)=5

$Z_2^5$ (2 fibers in each substrate)=10

$Z_3^5$ (3 fibers in each substrate)=10

$Z_4^5$ (4 fibers in each substrate)=5

$Z_5^5$ (all 5 fibers in a substrate)=1

Figure 10:
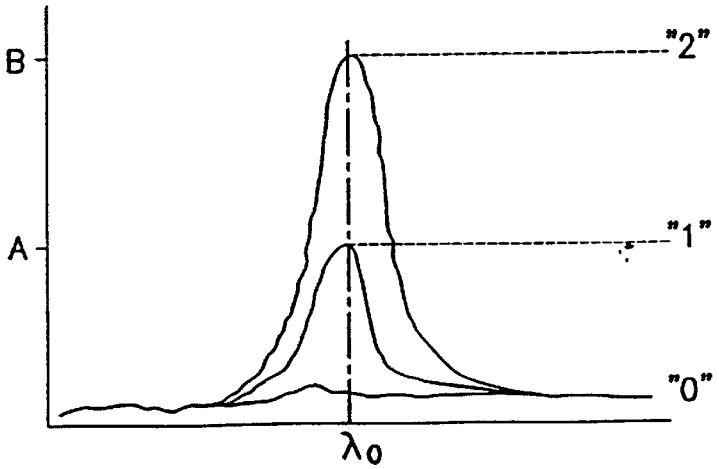
FIG. 10 depicts emission wavelength signal amplitude and is useful in explaining an embodiment of this invention wherein both wavelength and signal level amplitude coding are employed.

An increased coding capacity can be obtained by allowing for more bits to be associated with each wavelength. This may be accomplished by considering the signal levels at each wavelength, as is indicated in FIG. 10 for a specific wavelength $\lambda_0$. The signal level may be directly controlled by the density of each of the coding emitters in each substrate. For example, three bits at a given $\lambda_0$ can be created as:

"0", no emission at $\lambda_0$

"1", emission at a signal strength=A

"2", emission at a signal strength=B>A, where A is a chosen signal level corresponding a given loading of the lasing emitter.

Further by example, the information encoded at $\lambda_0$ can be as follows:

"0", no emission at $\lambda_0$

"+1", emission at a signal strength=A

"−1", emission at a signal strength=B>A.

Using an exemplary trinary scheme as described, M different wavelengths can create $3^M-1$ discrete codes. If Y discrete amplitude levels are chosen, then there are $Y_M^{-1}$ choices.

In an exemplary multi-level coding scheme, for M=3, Y=3, a total of 26 codes are provided, as opposed to seven in the strictly binary case.

The teaching of this invention generally encompasses the use of security structures, which are considered to be a multi-component material, fibers, such as polymer filaments and textile threads, as well as planchettes, which may be disk-like round or polygonal bodies that are placed into the paper or other substrate, and which include a coating having the optical emitter.

This invention thus teaches a security structure comprising a gain medium coupled to a structure that supports the creation of at least one mode for electromagnetic radiation.

This invention further teaches a security structure comprising a gain medium coupled to a structure having a dimension or length in one or more directions for producing and supporting amplified spontaneous emission (ASE).

This invention further teaches a security device comprising an optical gain medium and a structure having boundaries that impart an overall geometry to the structure that, in combination with at least one material property of the structure, supports an enhancement of electromagnetic radiation emitted from the gain medium for favoring the creation of at least one mode that enhances an emission of electromagnetic radiation within a narrow band of wavelengths. Suitable, but not limiting, shapes for the structure comprise elongated, generally cylindrical shapes such as filaments, a sphere shape, a partial-sphere shape, a toroidal shape, a cubical and other polyhedral shape, and a disk shape. The structure is preferably comprised of at least one of a monolithic structure or a multi-layered structure or an ordered structure that may provide for distributed optical feedback. In a preferred embodiment of this invention the security device forms a part of a currency, a passport, a lottery ticket, a negotiable security, a credit card or debit card, or any substrate or carrier which it is desired to at least one of authenticate, count, encode, sort or verify.

Thus, while the invention has been particularly shown and described with respect to preferred embodiments thereof, it will be understood by those skilled in the art that changes in form and details may be made therein without departing from the scope and spirit of the invention.

What is claimed is:

1. A method for processing a document, comprising the steps of:

providing a document to be authenticated, the document comprising a substrate and at least one security structure comprised of an optical gain medium and a structure for at least one of (a) favoring the creation of at least one mode or (b) supporting amplified spontaneous emission;

illuminating at least a portion of the document with light selected for exciting the gain medium;

detecting an emission of at least one wavelength from the document in response to the step of illuminating; and declaring the document to be authentic only if the emission is detected and confirmed to be a laser-like emission.

2. A method as in claim 1, wherein step of providing a document provides a document having security structures that comprise a polymer layer that functions as the structure that favors the creation of the at least one mode.

3. A method as in claim 1, wherein the security structures are comprised of at least one filament.

4. A method as in claim 1, wherein the security structures are each comprised of a multilayered structure.

5. A method as in claim 4, wherein one of the layers of the multilayered structure is comprised of a reflecting layer.

6. A method as in claim 4, wherein one of the layers of the multilayered structure is comprised of a reflecting layer that is patterned and that modulates a thickness of an overlying layer.

7. A method as in claim 1, wherein the security structure has an index of refraction that differs from an index of refraction of the substrate such that the security structure is non-indexed matched to the substrate.

8. A method as in claim 1, wherein the security structure is comprised of at least one filament, and wherein the emitted wavelength is a function of a diameter of the filament.

9. A method as in claim 1, wherein the security structure is comprised of a planchette, and wherein the emitted wavelength is a function of the thickness of the planchette.

10. A method as in claim 1, wherein the security structure is comprised of a DFB structure comprised of alternating regions, and wherein the emitted wavelength is a function of the thickness of individual ones of the regions.

11. Apparatus for at least one of authenticating, sorting or counting documents, comprising:

a light source for illuminating all or a portion of a document, the document comprising a substrate and at least one device located in or on said substrate, said device being comprised of an optical gain medium and a structure for at least one of (a) favoring the creation of at least one mode or (b) supporting amplified spontaneous emission for outputting at least one predetermined emission wavelength, said light source outputting light having wavelengths that are predetermined to excite said gain medium;

at least one detector responsive to said predetermined emission wavelength for detecting the presence of the at least one predetermined emission wavelength; and decision logic, having an input coupled to an output of said at least one detector, for at least one indicating the authenticity of the document based at least in part on a detection of the at least one predetermined emission wavelength, for counting the document based at least in part on a detection of the at least one predetermined emission wavelength or on the absence the at least one predetermined emission wavelength, or for sorting the document based at least in part on a detection of the at least one predetermined emission wavelength or on the absence the at least one predetermined emission wavelength.

12. Apparatus as in claim 11, wherein said detector is comprised of a plurality of discrete photodetectors.

13. Apparatus as in claim 11, wherein said detector is comprised of an area array.

14. Apparatus as in claim 11, wherein said detector is comprised of a spectrum analyzer.

15. Apparatus as in claim 11, wherein said device emits a single wavelength.

16. Apparatus as in claim 11, wherein said device emits a plurality of wavelengths.

17. A method for processing a document, comprising the steps of:

providing a document comprising a substrate and at least one device that is comprised of an optical gain medium and a structure coupled to said gain medium for at least one of (a) favoring the creation of at least one mode or (b) supporting amplified spontaneous emission, said device encoding information that is made manifest by an emission from said device;

illuminating at least a portion of the document with light selected for exciting the gain medium;

detecting an emission of at least one wavelength from the document in response to the step of illuminating; and obtaining the information that was encoded in the device from the detected emission.

18. A method as in claim 17, and further comprising a step of declaring the document to be authentic only if the emission is detected and confirmed to be a laser-like emission.

19. A method as in claim 17, and further comprising a step of directing further processing of the document based on the obtained information.

20. A method as in claim 17, wherein the information is encoded using only wavelength encoding.

21. A method as in claim 17, wherein the information is encoded using both wavelength encoding and signal level encoding.

22. A method as in claim 17, wherein the information is encoded using a single level encoding.

23. A method as in claim 17, wherein the information is encoded using a multi-level encoding.

* * * * *